US011147741B2

(12) United States Patent
Brouard et al.

(10) Patent No.: US 11,147,741 B2
(45) Date of Patent: Oct. 19, 2021

(54) DEVICE FOR COUNTING AND DISPENSING OBJECTS

(71) Applicant: STIPLASTICS, Beauvoir en Royans (FR)

(72) Inventors: Hugues Brouard, Rochefort Samson (FR); Guillaume Zoczek, Tullins (FR)

(73) Assignee: STIPLASTICS

( * ) Notice: Subject to any disclaimer, the term of this patent is extended or adjusted under 35 U.S.C. 154(b) by 0 days.

(21) Appl. No.: 15/117,411

(22) PCT Filed: Feb. 12, 2015

(86) PCT No.: PCT/EP2015/052972

§ 371 (c)(1),
(2) Date: Aug. 8, 2016

(87) PCT Pub. No.: WO2015/121353

PCT Pub. Date: Aug. 20, 2015

(65) Prior Publication Data

US 2016/0346166 A1 Dec. 1, 2016

(30) Foreign Application Priority Data

Feb. 12, 2014 (FR) ..... 1451065

(51) Int. Cl.

| | |
|---|---|
| ***A61J 7/00*** | (2006.01) |
| ***B65D 83/04*** | (2006.01) |
| ***A61J 7/02*** | (2006.01) |

(52) U.S. Cl.

CPC ..... *A61J 7/0076* (2013.01); *A61J 7/02* (2013.01); *B65D 83/0409* (2013.01)

(58) Field of Classification Search

CPC ..... A61J 7/02; A61J 7/0481; A61J 7/0076; B65D 83/0409; B65D 83/04

(Continued)

(56) References Cited

U.S. PATENT DOCUMENTS 1,383,623 A * 7/1921 Groves ..... B65B 5/103 53/493
2,683,554 A * 7/1954 Mulhauser, Jr. ... B65D 83/0409 221/152

(Continued)

FOREIGN PATENT DOCUMENTS

CA 1297844 C 3/1992
DE 102011112953 A1 3/2013

(Continued)

OTHER PUBLICATIONS

International Search Report for Application No. PCT/EP2015/052972 dated May 4, 2015.

*Primary Examiner* — Rakesh Kumar
(74) *Attorney, Agent, or Firm* — Lerner, David, Littenberg, Krumholz & Mentlik, LLP

(57) ABSTRACT

The invention relates to a device (1) for counting and dispensing objects (2), comprising two slidably movable elements (10, 11) relatively to each other, a first element (10) comprising a conduit (100) for dispensing objects to be counted and dispensed, the second element (11) cooperating with the first element for forming two obturators (1A, 1B) delimiting in the dispensing conduit (100) a chamber (101) adapted for containing a determined number of said objects, said obturators (1A, 1B) being able to adopt, depending on the relative position of said first and second elements:

an open configuration, in which the obturator defines an orifice with a dimension adapted for letting through an object to be counted and dispensed, and an obturation configuration, wherein said orifice has an insufficient dimension for letting through an object, the first and second elements being laid out for providing, by relative sliding, an operating sequence of the obturators wherein:

(Continued)

(i) a first obturator is in an open configuration while the second obturator is in an obturation configuration,
(ii) the obturators are both in an obturation configuration,
(iii) the first obturator is in an obturation configuration while the second obturator is in an open configuration,
(iv) the obturators are both in an obturation configuration.

13 Claims, 10 Drawing Sheets

(58) Field of Classification Search
USPC ..... 221/7, 276
See application file for complete search history.

(56) References Cited

U.S. PATENT DOCUMENTS 2,786,566 A * 3/1957 Taggart ..... A61J 3/074 221/168
3,410,452 A * 11/1968 Igel ..... B65G 47/1407 221/13
3,968,902 A * 7/1976 Bachmann ..... B65D 83/0409 221/263
4,113,143 A * 9/1978 Spagnola, Jr. ..... A63F 11/0002 221/267
4,146,151 A * 3/1979 Davis ..... G07D 1/08 221/264
4,405,060 A * 9/1983 Hsei ..... B65D 83/0409 221/135
4,445,018 A * 4/1984 Holmgren ..... H01H 33/905 218/59
4,457,451 A * 7/1984 Ichikawa ..... B65G 47/1407 221/190
4,648,529 A * 3/1987 Blakemore ..... B65D 81/22 210/803
4,653,668 A * 3/1987 Gibilisco ..... B65D 83/0409 206/540
4,679,377 A * 7/1987 Rieben ..... G21C 3/10 53/327
4,854,478 A * 8/1989 Gyimothy ..... B65D 83/0409 221/190
4,913,315 A * 4/1990 Wagner ..... B01F 11/0258 221/200
5,054,649 A * 10/1991 Lemaire ..... B23P 19/003 221/248
5,737,902 A * 4/1998 Aylward ..... B65B 39/14 53/475
5,829,632 A * 11/1998 Gehlert ..... B65G 47/1407 221/268
5,852,259 A * 12/1998 Yanase ..... G01G 17/00 177/145
6,162,998 A * 12/2000 Wurst ..... G01G 17/00 177/145
6,237,804 B1 * 5/2001 Peery ..... G07F 11/44 221/152
6,899,144 B1 * 5/2005 Geltser ..... A61J 7/02 141/104
7,523,594 B2 * 4/2009 Greenwald ..... B65B 5/103 221/172
7,892,473 B2 * 2/2011 Aylward ..... B65B 35/12 264/401
8,826,631 B2 * 9/2014 Singer ..... B65B 39/007 53/255
8,936,175 B1 * 1/2015 Song ..... A61J 7/0481 221/276
9,101,531 B1 * 8/2015 Song ..... A61J 7/0472
9,394,070 B2 * 7/2016 Pearson ..... B65B 57/14
2008/0041875 A1 * 2/2008 Lancesseur ..... B65D 83/0409 221/135
2011/0284568 A1 * 11/2011 Leifeld ..... B65D 83/0418 221/1
2016/0031631 A1 2/2016 Kim
2016/0207691 A1 * 7/2016 Benouali ..... B65D 81/266
2016/0271769 A1 * 9/2016 Jin ..... B25B 23/065
2016/0346166 A1 * 12/2016 Brouard ..... A61J 7/02
2017/0281471 A1 * 10/2017 Hamilton ..... A61J 7/0076
2019/0307310 A1 * 10/2019 Fletcher ..... D06F 39/026
2019/0307311 A1 * 10/2019 Fletcher ..... A47L 15/449
2020/0221924 A1 * 7/2020 Fletcher ..... A47L 15/449

FOREIGN PATENT DOCUMENTS

EP 0002403 A1 6/1979
EP 0051994 A1 * 5/1982 ..... B65D 83/0409
EP 0051994 A1 5/1982
FR 2759677 A1 8/1998
FR 2867459 A1 9/2005
FR 2928356 A1 9/2009
KR 20110096027 A 8/2011
KR 101362648 B1 2/2014
WO 2009018392 A2 2/2009
WO 2009080309 A2 7/2009

* cited by examiner

DEVICE FOR COUNTING AND DISPENSING OBJECTS

CROSS REFERENCE TO RELATED APPLICATIONS

The present application is a national phase entry under 35 U.S.C. § 371 of International Application No. PCT/EP2015/052972, filed Feb. 12, 2015, which claims priority from French Patent Application No. 1451065, filed Feb. 12, 2014, the disclosures of which are incorporated by reference herein.

FIELD OF THE INVENTION

The invention relates to a device for counting and dispensing objects such as beads, granules, micro-granules, tablets or capsules, and to a container containing such objects and comprising such a device, notably a tube of homeopathic granules.

BACKGROUND OF THE INVENTION

Within the scope of homeopathic treatment for example, a determined number of granules have to be administered to a patient, without said granules being directly handled by the patient.

A certain number of dispensers have thus been developed with view to issuing a determined number of granules.

Document EP 0 002 403 describes a dispenser of granules laid out at the end of a container containing granules and comprising a rotary disc including an orifice for letting though a granule and a lug for retaining the remaining granules in the container. In order to release a granule, the rotary disc has to be brought into a first position in which it allows admission of a granule into a cell laid out in a stopper fixed on the container and then the rotary disc has to be turned so as to bring the passage orifice in front of the cell in order to allow the passing of the granule into the stopper.

Document FR 2 759 677 describes as for it, a dispenser of granules comprising a neck having a helical ramp for flow of the granules and an element comprising a housing for a granule and movable in sliding between an admission position of a granule from the ramp and a position for releasing the granule.

Document FR 2 867 459 describes a dispenser of granules, the operation of which is based on elastic deformation of said dispenser by applying a pressure in a direction transverse to the direction of flow of the granules.

Document CA 1,297,844 describes a dispenser of granules laid out at the end of a tube and comprising a chimney capable of pivoting between a centered position with respect to the tube allowing admission of a determined number of granules and an off-center position with respect to the tube in which it blocks the passage of the granules and allows release of the granules out of the container.

Finally, document FR 2 928 356 describes a dispenser of tablets comprising a tank of tablets and a sliding drawer including a housing for a tablet. Said drawer is designed so as to adopt different successive positions in which it either communicates with the tank on the one hand and with an outlet orifice on the other hand for allowing release of a single tablet at a time.

Now, the homeopathic granules are objects with a substantially spherical shape but for which the dimensions may vary in a relatively wide range around a rated diameter.

Therefore, in the presence of granules with a diameter larger than the rated diameter, there exists a risk that the granule be greater than the housing provided for receiving it, so that the setting into motion (rotation or translation) of the housing intended to transfer the granule from the tank to an outlet orifice exerts a shearing force on the granule, possibly inducing breakage of the granule and/or jamming of the dispenser.

Conversely, in the presence of granules of a diameter less than the rated diameter, the risk is that two granules simultaneously engage into the housing. The setting into motion of the housing then exerts a great shearing force on the granule which is only partly engaged into the cell, which may then cause breakage of said granule and/or jamming of the dispenser. In the particular case of tablets with a film, this breakage may be detrimental to the actual efficiency of the drug treatment, the active ingredients not having time for attaining their target.

In homeopathic applications, for which the grain size is generally not very controlled, a problem often encountered with existing dispensers is the absence of release of the expected granule at the end of the actuation sequence of the dispenser.

Other applications, notably in the pharmaceutical field, assume that a determined number of objects are dispensed. For example such is the case of gel capsules, micro-granules, capsules and tablets.

SHORT DESCRIPTION OF THE INVENTION

A goal of the invention is therefore to design a device for counting and dispensing objects which avoids the problems encountered with existing dispensers and notably which limits or even suppresses the risks of jamming and of malfunction of the dispenser and which minimizes the forces exerted on the objects in order to preserve their integrity. A goal of the invention is also to design a device which allows reliable counting of the issued objects. Another goal of the invention is to design a device for counting and dispensing which may be manufactured with a reduced number of elements and with methods compatible with manufacturing in large series, in order to ensure the economic competitiveness of the dispenser as compared with existing devices.

According to the invention, a device for counting and dispensing objects is proposed, comprising two slidably movable elements relatively to each other,

- a first element comprising a conduit for dispensing objects to be counted and dispensed,
- the second element cooperating with the first one for forming two obturators delimiting in the dispensing conduit a chamber adapted for containing a determined number of said objects,
- said obturators being able to adopt, depending on the relative position of said first and second elements:
  - a so-called open configuration of the chamber, in which the obturator defines an orifice with a dimension adapted for letting through an object to be counted and dispensed, and
  - a so-called obturation configuration of the chamber, in which said orifice has a dimension insufficient for letting through an object, the obturator having two bevelled portions facing each other and not contiguously joined in said obturation configuration,
- the first and second elements being arranged so as to provide, by relative sliding, a sequence for operating the obturators wherein:

(i) a first obturator is in an open configuration while the second obturator is in an obturation configuration of the chamber, (ii) the first and the second obturators are both in an obturation configuration of the chamber, (iii) the first obturator is in an obturation configuration while the second obturator is in an open configuration of the chamber, (iv) the first and the second obturators are both in an obturation configuration of the chamber.

According to an embodiment, the first element is slidably laid out with respect to the second element along an axial direction of the conduit so that, during a portion of the operating sequence, the first element extends beyond the second element towards the upstream side relatively to the direction of flow of the objects, so as to provide mixing of the objects to be counted and dispensed located upstream from the conduit.

In a particularly advantageous way, the conduit has, at its upstream end, a tilted wall so as to orient and/or guide in the conduit the objects to be counted and dispensed.

According to a particular embodiment of the device, the first element comprises a generally tubular body having two pairs of opposite radial apertures and two pairs of flexible arms having a protrusion engaged into a respective radial aperture of the body, and the second element having a generally tubular shape, the wall of which is pierced with a pair of non-rectilinear grooves in which move two respective flexible arms during the sliding of the first element in the second element, the profile of said grooves being designed so as to vary the engagement of the protrusion of the flexible arms in the conduit. Each pair of protrusions defines together an obturator, the open or obturation configuration of which depends on the distance between two opposite protrusions.

According to another embodiment, the second element is slidably laid out with respect to the first element in a plane perpendicular to an axial direction of the conduit.

According to a particular embodiment of the device, the first element has a generally tubular shape, the wall of which is pierced with two pairs of apertures and the second element has two pairs of parallel arms extending perpendicularly to an axial direction of the conduit, each arm having a protrusion selectively engaged into the conduit through a respective aperture. The distance between two protrusions facing each other is sufficiently small for preventing the passage of an object; moreover, each arm has a portion without such a protrusion. Depending on the position of the first element with respect to the second element, the conduit is at least partly obturated by two protrusions facing each other, thereby defining an obturator in an obturation configuration, or the conduit is not obturated by said protrusions, thereby defining the open configuration of said obturator.

Advantageously, each protrusion has a bevelled shape. This bevelled shape cooperates with the convex end of each object in order to avoid shearing of said object when the obturator operates.

Preferably, in an obturation configuration of an obturator, said bevelled protrusions facing each other are not contiguously joined up.

According to an advantageous embodiment, the device further comprises a device for relatively returning the first and second elements.

Preferably, said return device comprises an elastic return member secured to the first or to the second element.

According to a preferred embodiment of the device, the first and the second element are each made in one piece and the device is exclusively consisting of said first and second elements.

Another object of the invention relates to a container containing objects and comprising a device for counting and dispensing said objects as defined above.

According to an advantageous application of the invention, the objects are homeopathic granules, gel capsules, tablets, capsules or micro-granules.

SHORT DESCRIPTION OF THE DRAWINGS

Other features and advantages of the invention will become apparent from the detailed description which follows, with reference to the appended drawings wherein:

FIGS. 1A to 1H illustrate various examples of objects which may be dispensed by the device according to the invention, FIGS. 2A to 2D schematically illustrate the different configurations of the obturators of a device according to the invention, FIGS. 3A to 3D schematically illustrate the relative position of a bead contained in the chamber and of the obturators depending on the size of the rounded object, FIG. 4 schematically illustrates a device according to the invention in which the objects to be dispensed are gel capsules, FIGS. 5A to 5E illustrate the elements of a device according to a first embodiment of the invention, FIGS. 6A to 6C illustrate the elements of a device according to a second embodiment of the invention, FIGS. 7A and 7B illustrate an alternative of the device of FIGS. 5A to 5E comprising a return device of an element with respect to the other, FIGS. 8A and 8B illustrate an alternative of the device of FIGS. 6A to 6C comprising a return device of one element relatively to the other.

DETAILED DESCRIPTION OF EMBODIMENTS OF THE INVENTION

The invention generally applies to the dispensing of any object having a spherical or spheroidal shape or further an elongated shape with convex ends. According to a non-limiting embodiment, the objects may have rotational symmetry with respect to an axis which extends between both convex ends.

In the present text, by "elongated" is designated an object for which the largest dimension (or length) extends between both convex ends.

The elongated objects are intended to be oriented in a conduit of the counting and dispensing device one following the others in the direction of their largest dimension.

FIGS. 1A to 1G illustrate a few examples of such objects.

A gel capsule is illustrated in FIG. 1A. Said gel capsule may be defined as having a cylindrical portion of circular section and two symmetrical hemispherical ends, for which the radius of curvature is equal to the radius of the cylindrical portion. The distance between both hemispherical ends is greater than the diameter of the circular portion.

Figure 1A:
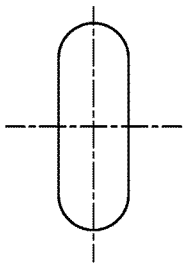
FIG. 1B illustrates a spherical object, such as a granule.
FIG. 1C illustrates a micro-granule, which is a micro-tablet, with a diameter typically varying from 0.8 to 4 mm, having a constant cylindrical section over a length typically equal to the diameter and having ends for which the section changes with shrinkage, notably as a spherical cap.
Figure 1B:
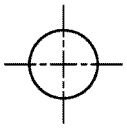
Figure 1C:
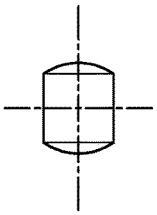
Figure 1D:
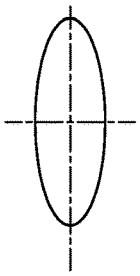

A capsule is illustrated in FIG. 1D. Said capsule may be defined as an ellipsoid of revolution.

Figure 1E:
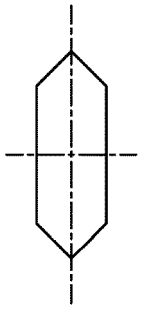

FIG. 1E illustrates an object having a cylindrical portion of circular section and two symmetrical pointed ends. The distance between the pointed ends is greater than the diameter of the cylindrical portion.

Figure 1F:
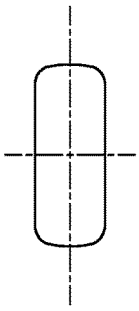

FIG. 1F illustrates an object having a cylindrical portion of circular section and two symmetrical rounded ends. The radius of curvature may be more or less large but the case when the ends are planar is excluded.

Figure 1G:
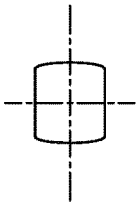

FIG. 1G shows a borderline case when the variation of the sections of the ends decreases very rapidly, without however being a cylinder with constant section, and for which devices according to the invention are effective.

Figure 1H:
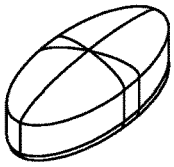

FIG. 1H illustrates the case of a tablet which, unlike the objects of FIGS. 1A to 1G, does not have rotational symmetry. This object may be defined as having a cylindrical straight portion, the base of which is an ellipse and two faces as ellipsoids. The ends of the object correspond to the ends of the major axis of the ellipse.

Generally, all the shapes obtained within the field of solid galenic field (except for powders, the particles of which are not considered as objects to be counted), may be applied to the objects to be dispensed by the device of the invention.

In pharmaceutical applications, the objects may be granules, micro-granules, capsules, tablets, egg-shaped forms or further gel capsules.

However, any object having one of the alternatives of the forms described above, regardless of its dimensions and proportions, may be dispensed in a determined number by means of a device according to the invention. The invention therefore finds application generally in any field of industry, including the agri-food industry, in which it is necessary to dispense a determined number of objects.

FIGS. 2A to 2D illustrate the operating principle of the first obturators 1B and the second obturator 1A in a counting and dispensing device (also-called a "dispenser" in the continuation of the text) according to the invention, applied as an example to the dispensing of beads 2.

In these figures, the tank 3 of beads 2 is located in the upper portion of the dispenser and communicates with a conduit 100 for dispensing the beads which extends along a longitudinal axis X. The direction of flow of the beads from the tank 3 to the outlet of the dispenser is illustrated by the arrow. For the dispensing of beads, the axis X is oriented in a vertical or oblique direction, with the tank above the dispenser, so as to allow the beads to flow by gravity into the conduit 100.

The conduit 100 has, perpendicularly to the axis X, a section adapted for letting through a single bead, so that the beads are superposed in the conduit 100.

If the objects to be dispensed are elongated objects, the section of the conduit 100 is adapted for letting through the objects in the direction of their length, i.e. the objects are superposed in the conduit 100 with their convex ends facing each other. The section of the conduit 100 does not allow the passing of an object in an orientation other than that of its length, nor the simultaneous passing of two objects or more through a given section of the conduit.

Advantageously, the junction between the tank of beads and the dispenser assumes the shape of a funnel which gives the possibility of avoiding bracing of the beads at the entry of the conduit 100. Indeed, spherical or elongated objects with convex ends, considering their symmetries, may tend to be organized so that, taken through the centre of the bottom of a tank, they themselves form a stable, pseudo-tubular structure and therefore hollow in its center, which can only collapse in order that the taking may continue, than under the action of mechanical mixing.

The inner section of the tank 3 is generally greater than that of the conduit 100 and the inner wall of the tank advantageously comprises a portion 1130 tilted towards the downstream side in the direction of shrinkage of the section. The upstream end of the conduit 100 as for it, has a wall 1030 which is tilted in the same direction as the portion 1130.

The obturators 1A and 1B are respectively located in the downstream and upstream portions of the conduit 100 with respect to the direction of flow of the beads.

The obturators 1A and 1B delimit between them a portion of the conduit 100 which is a chamber 101 intended to contain a determined number of beads. In the example illustrated in FIGS. 2A to 2D, the chamber is intended to receive a single bead, i.e. the distance between the obturators 1A and 1B along the axis X is equal to the rated diameter of a bead, but less than 1.5 times the rated diameter of a bead. However, the dispenser according to the invention may be designed so that the chamber 101 comprises two or more beads; for this it is sufficient to adapt the distance between the obturators 1A and 1B. The chamber 101 thus fulfills the function of counting the beads to be dispensed while giving the possibility of absorbing the dimensional tolerances inherent to the methods for manufacturing such objects.

Figure 2A:
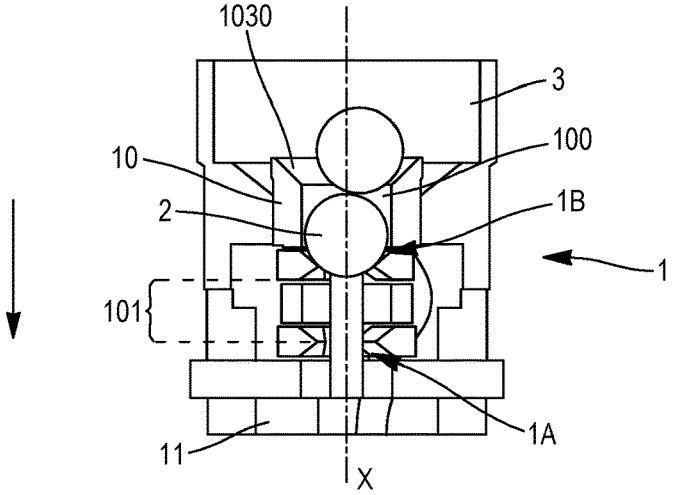

FIG. 2A illustrates a condition of the dispenser in which both obturators 1A, 1B are both in an obturation configuration of the chamber 101, which is then empty.

It will be noted that the portions facing each other of the obturators 1A, 1B are not joined contiguously but distant by an interval of less than the diameter of a bead, so as to block the passing of a bead 2 present in the conduit directly upstream from the obturator 1B. As this will be seen below, the fact that the obturators are not contiguously joined together has the advantage of giving the possibility of retaining the beads without exerting any shear on a bead contained in the chamber 101. Moreover, the portions facing each other of the obturators advantageously have a bevelled profile.

Figure 2B:
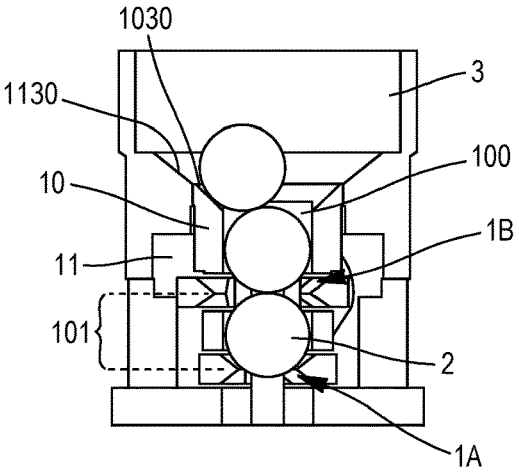

FIG. 2B illustrates a condition of the dispenser in which the upstream obturator 1B is in an open position of the chamber 101 while the downstream obturator 1A remains in an obturation configuration. Passing from the condition of FIG. 2A to that of FIG. 2B is obtained by relative sliding of two elements of the dispenser, embodiments of which will be described in detail below. In the embodiment illustrated here, which corresponds to the device illustrated in FIGS. 5A to 5E, the sliding is performed in the axial direction, the element 10 which comprises the passage 100 being moved downstream with respect to an element 11 of the dispenser fixed relatively to the tank 3. It will be noted that, in the configuration of FIG. 2B, the portion 1030 with the shape of a funnel of the element 10 is ideally found, but not imperatively, in the extension of the tilted portion 1130 of the tank 3, which facilitates the entry of the beads into the conduit 100.

Thus, the predetermined number of beads intended to be received in the chamber 101 (here, a single bead 2) enters said chamber.

Figure 2C:
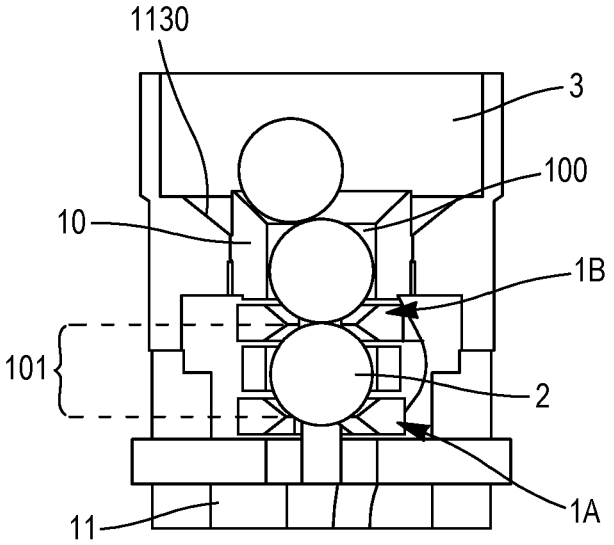

FIG. 2C illustrates a condition of the dispenser wherein the upstream 1B and downstream 1A obturators are in an obturation configuration of the chamber 101. The transition from the condition of FIG. 2B to that of FIG. 2C is obtained by relative sliding of both elements of the dispenser. In the embodiment illustrated here, this sliding is performed in the axial direction, downstream to upstream.

The bead 2 is therefore retained in the chamber 101 between both obturators, no bead being able to enter the chamber 101 or exit from it.

Figure 2D:
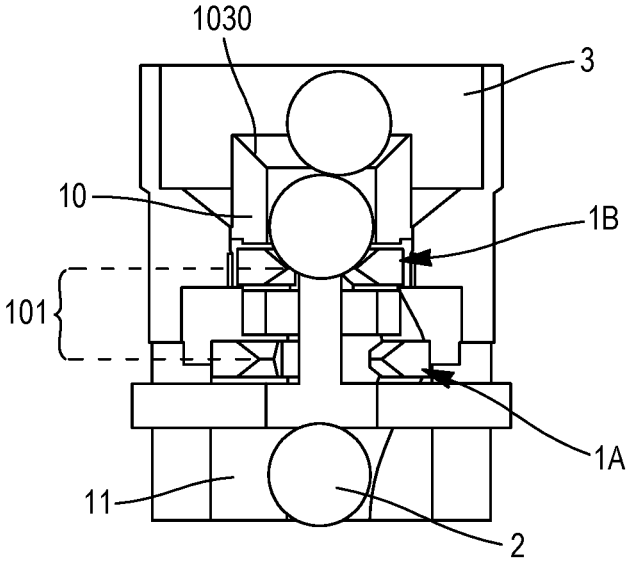

The fact that the obturator 1B is bevelled gives the possibility that during the closing motion of said obturator, exertion of a shear stress on the bead contained in the chamber 101 or on the bead directly located upstream from said obturator 1B is avoided. Finally, FIG. 2D illustrates a condition of the dispenser in which the upstream obturator 1B remains in the configuration of the chamber 101 while the downstream obturator 1A is in an open configuration of said chamber. The passing from the condition of FIG. 2C to that of FIG. 2D is obtained by relative sliding of both elements of the dispenser. In the embodiment illustrated here, this sliding is performed in the axial direction, downstream to upstream. It will be noted that this sliding has the effect of having the element 10 penetrate into the tank 3, thereby producing a mixing of the beads which very efficiently avoids possible bracing of the beads at the entry of the tank.

The aperture of the downstream obturator 1A allows the bead 2 (or the beads if two or more beads were contained in the chamber 101) to escape from the chamber and thus be extracted from the dispenser.

The next step of the operating sequence comprises the closing of the obturator 1A, as illustrated in FIG. 2A. The transition from the condition of FIG. 2D to that of FIG. 2A is obtained by relative sliding of both elements of the dispenser. In the embodiment illustrated here, this sliding is performed in the axial direction, from upstream to downstream.

If other beads have to be extracted, the sequence described above is again applied until the desired total number of beads is obtained.

As mentioned above, the conformation of the obturators, i.e. the fact that they are not contiguously joined in an obturation configuration and that they have a bevelled profile, gives the possibility of avoiding the exertion of a shear stress on a bead inserted into the chamber 101 or on a bead upstream from the obturator 1B which would be partially engaged into the chamber 101 and this, even if the size of the beads varies in a determined range.

Figure 3A:
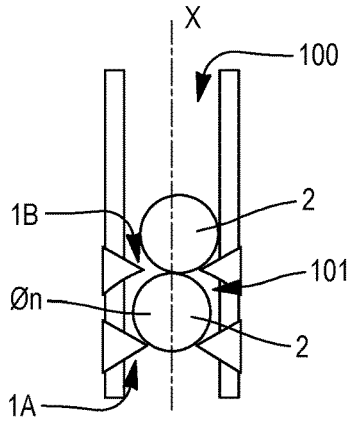

FIG. 3A corresponds to the case when a bead 2 for which the diameter is equal to the rated diameter Øn of the beads is in the chamber 101 (it is considered here that the chamber 101 is designed for receiving a single bead, but this embodiment is not limiting).

The distance between the obturators 1A and 1B, which is defined as the distance between the planes perpendicular to the axis X containing the tip of each bevel, is such that the upper end of the bead is flush with the plane containing the end of the bevel of the upstream obturator 1B. The bead 2 located just upstream from the obturator 1B is in contact both with the bead 2 contained in the chamber 101 and with the upstream portion of the bevel of the obturator 1B.

Figure 3B:
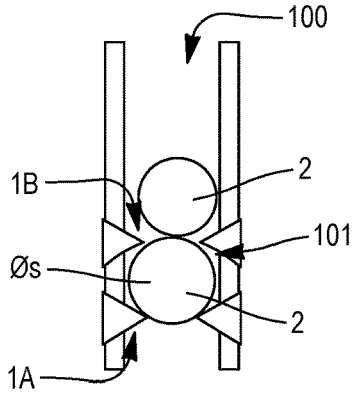

FIG. 3B corresponds to the case wherein a bead 2, the diameter of which is equal to the maximum diameter (noted as Øs) of the beads considering the manufacturing tolerances is in the chamber 101.

The distance between the obturators 1A and 1B is identical with that of the dispenser of FIG. 3A. In this case, the upper end of the bead 2 contained in the chamber 101 juts out towards the upstream side of the plane containing the end of the bevel of the upstream obturator 1B. The upstream obturator 1B has a sufficient aperture so as not to exert any stress on the bead 2 contained in the chamber 101. The bead 2 located just upstream from the obturator 1B is exclusively in contact with the bead 2 contained in the chamber 101.

Figure 3C:
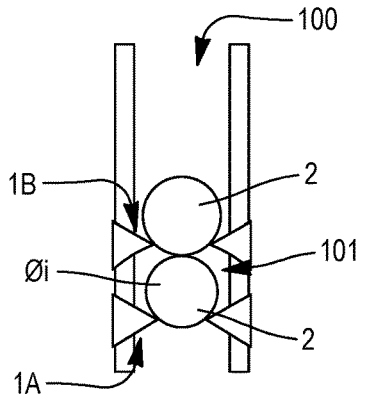

FIG. 3C corresponds to the case when a bead 2 is in the chamber 101, the diameter of the bead being equal to the minimum diameter (noted as θi) of the beads considering the manufacturing methods and the tolerances which they generate.

The distance between the obturators 1A and 1B is identical with that of the dispenser of FIGS. 3A and 3B. In this case, the upper end of the bead 2 contained in the chamber 101 is located set back towards the downstream side with respect to the plane containing the end of the bevel of the upstream obturator 1B. When the upstream obturator 1B is in an open configuration in order to let the bead 2 enter the chamber 101, a second bead 2 located just upstream from said bead is engaged into the chamber 101; however, when the upstream obturator 1B has returned to its obturation configuration of the chamber 101, its bevelled shape gave the possibility of pushing back the upstream bead which was engaged into the chamber 101, without exerting any shear stress on the latter.

Figure 3D:
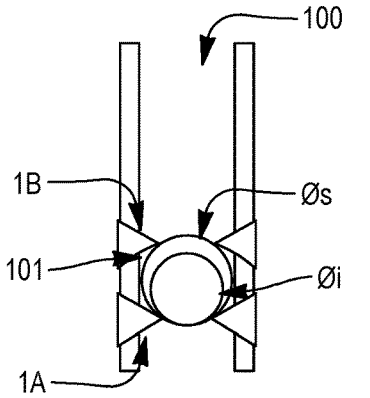

As illustrated in FIG. 3D, it is therefore possible to size the obturators by taking into account the minimum diameter Øi and the maximum diameter Øs of the beads intended to be dispensed.

Figure 4:
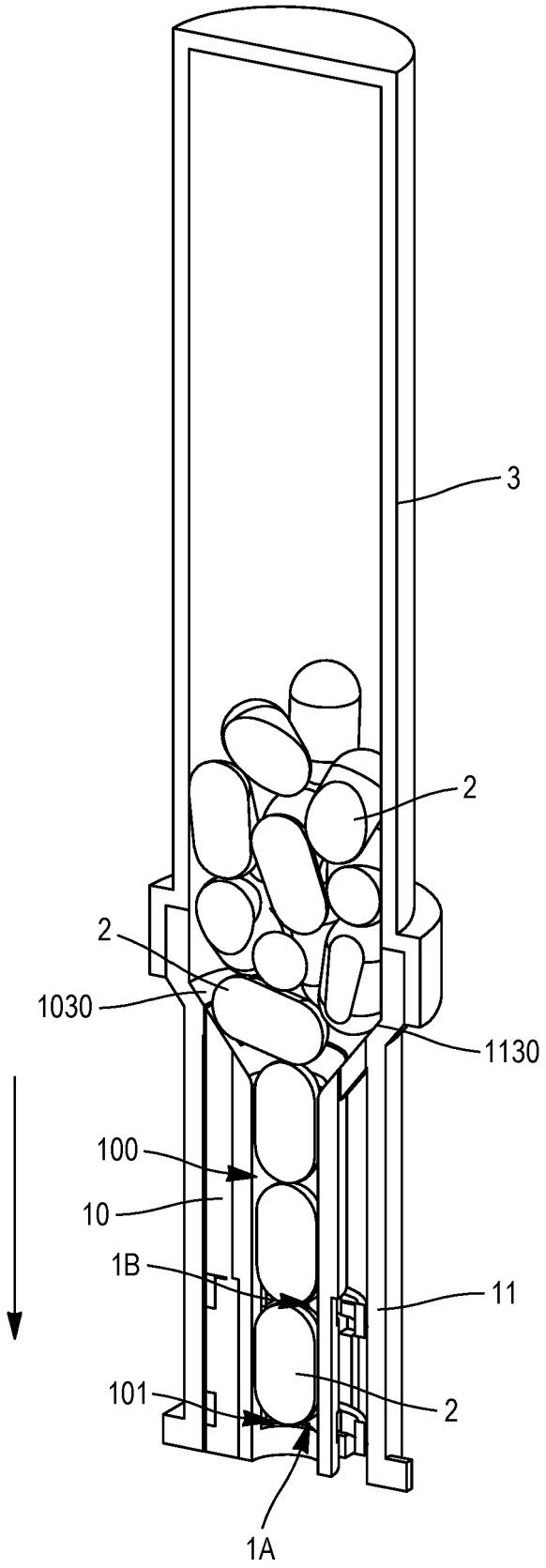

As indicated above, the invention is not limited to the dispensing of beads and FIG. 4 illustrates as an example the operation of the dispenser for dispensing gel capsules.

In this figure, a container containing gel capsules 2 is illustrated in a position for dispensing gel capsules, the tank 3 being positioned above the elements 10, 11 which make up the dispenser. The operating principle of the dispenser is similar to the one illustrated in FIGS. 2A to 2D.

The element 10, which comprises the conduit 100 for dispensing the gel capsules, is laid out so as to slide in the element 11, which is secured to the container 3.

The element 10 and the element 11 each have in their upstream portion a respective tilted wall 1030, 1130.

In FIG. 4, said walls are in the extension of each other. This situation corresponds to the case of FIG. 2C, wherein both obturators 1A and 1B are in a position for closing the chamber 101, which contains a gel capsule 2.

When the element 10 is slid upstream, i.e. in the direction opposite to the arrow, its tilted wall 1030 extends towards the upstream side beyond the wall 1130 in the tank 3 and has the effect of providing mechanical mixing of the gel capsules on the one hand and of orienting the gel capsule which is contained in the flared upper end of the conduit 100 in the direction of its length on the other hand, thereby allowing said gel capsule to enter the conduit 100.

A first embodiment of a dispenser according to the invention will now be described with reference to FIGS. 5A to 5E. This dispenser is similar to the one illustrated in FIGS. 2A to 2D and in FIG. 4.

Figure 5A:
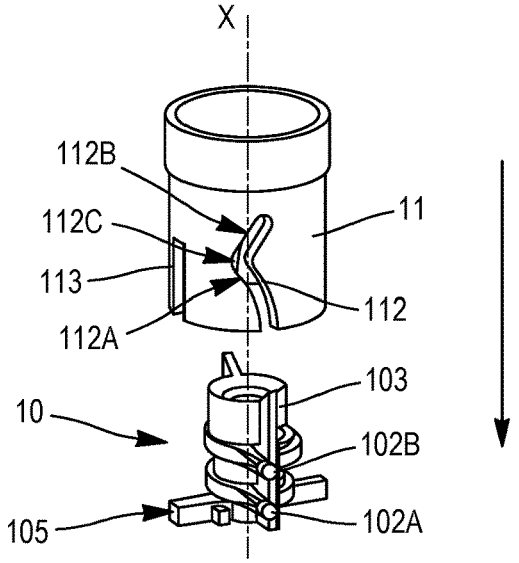

FIG. 5A is an exploded perspective view of both elements 10, 11 of the dispenser which cooperate for forming the obturators. The arrow indicates the direction of flow of the beads from upstream to downstream.

The element 11 has a generally tubular shape extending along the axis X and the wall of which is pierced with two parallel diametrically opposite grooves 112 which extend from the downstream edge of the element 11. The grooves 112 are not rectilinear but have two portions 112A, 112B tilted in opposite directions on either side of an inflection point 112C.

The wall of the element 11 is moreover pierced with two rectilinear grooves 113 diametrically opposite, parallel, which extends from the downstream side of the element 11.

The function of the grooves 112 and 113 will be explained below.

The element 10 is laid out so as to slide in the element 11, in the axial direction X.

The element 10 comprises a body 103 with a generally tubular shape extending along the axis X and the inner wall of which defines the conduit 100 for dispensing the beads.

From the body 103, perpendicularly to the axis X, extend two diametrically opposite rectilinear arms 105. Said arms 105 are located in the downstream portion of the body 103.

The element 10 moreover comprises two pairs of flexible arms 102A, 102B which extend radially substantially orthogonally to the rectilinear arms 105.

When the dispenser is assembled, the flexible arms 102A, 102B of the element 10 are inserted into the grooves 112 of the element 11 while the rectilinear arms 105 of the element 10 are inserted into the rectilinear grooves 113 of the element 11.

The cooperation of the rectilinear arms 105 and of the rectilinear grooves has the function of guiding the sliding of the element 10 in the element 11.

During this sliding, the arms 102A, 102B follow the path of the tilted grooves 112 and the cooperation of said arms with said grooves forms the obturators 1A, 1B and imposes the different configurations of said obturators.

During its use for dispensing beads, the element 11 of the dispenser is generally fixed relatively to the hand of the user, while the element 10 is slid into the element 11.

Figure 5B:
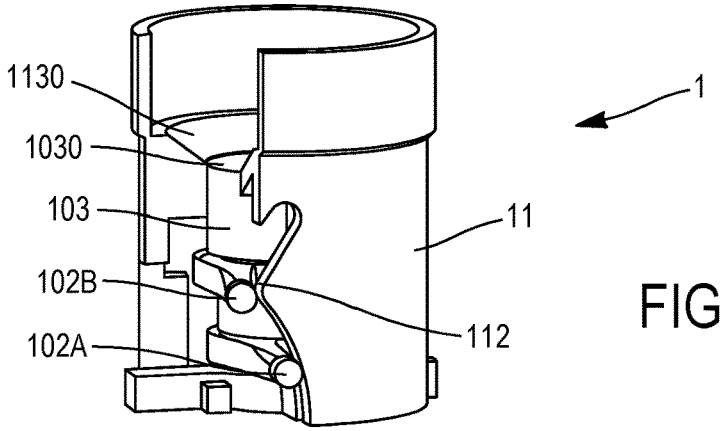
Figure 5C:
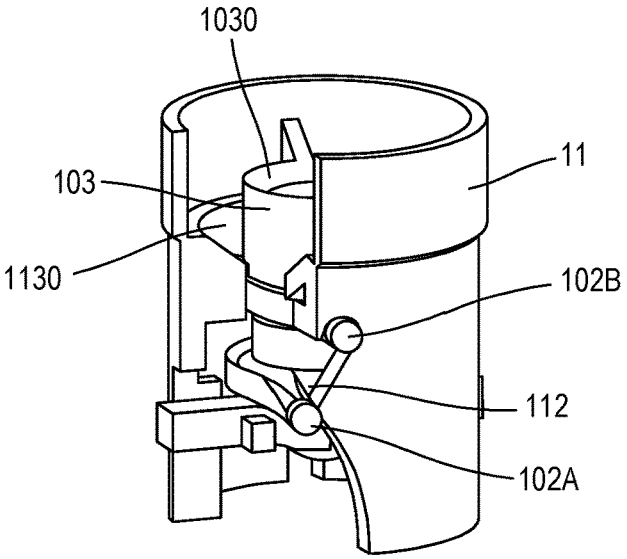

FIGS. 5B and 5C illustrate two different relative positions of the elements 10 and 11.

In the situation of FIG. 5B, the element 10 is located in the downstream portion of the element 11, the downstream edges of said elements being substantially in the same plane.

The flexible arms 102A, 102B are in the downstream portion 112A of the grooves 112.

Because of the slope of said portion 112A of the grooves 112, the arms 102A, which are downstream from the arms 102B are shifted with respect to the latter around the axis X.

Moreover, the slope of the downstream portion 112A of the grooves 112 tends to bring the arms 102A closer to each other while moving the arms 102B away from each other, so that the arms 102A define a downstream obturator in an obturation configuration while the arms 102B define an upstream obturator in an open configuration.

FIG. 5C illustrates a situation in which, relatively to FIG. 5A, the sliding of the element 10 in the element 11 continued in the upstream direction. In this direction, the upstream arms 102 having passed the inflection point 112C of the grooves 112 are found in the upstream portion 112B of said grooves, which has a slope in the direction opposite to that of the downstream portion 112A.

As the arms 102A are still in the downstream portion 112A of the grooves 112, they tend to move away from each other in order to provide a downstream obturator in an open configuration while the arms 102B tend to move closer to each other in order to provide an upstream obturator in an obturation configuration.

The grooves 112, 113 of the element 11 do not extend over the whole height of the latter and therefore provides an abutment of the element 10 towards the upstream side.

Figure 5D:
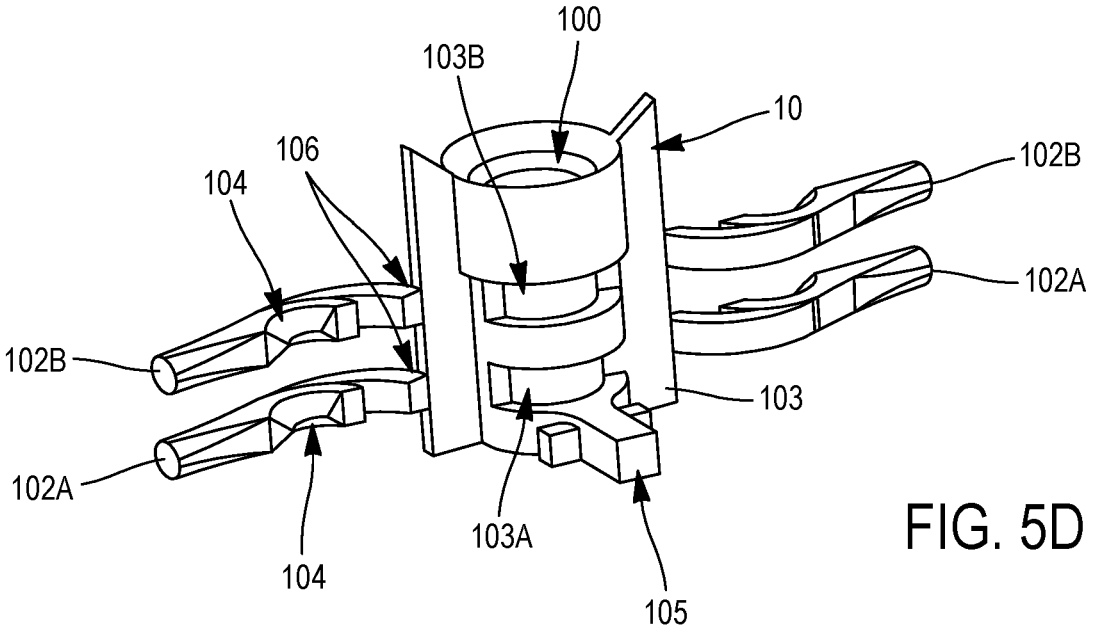
Figure 5E:
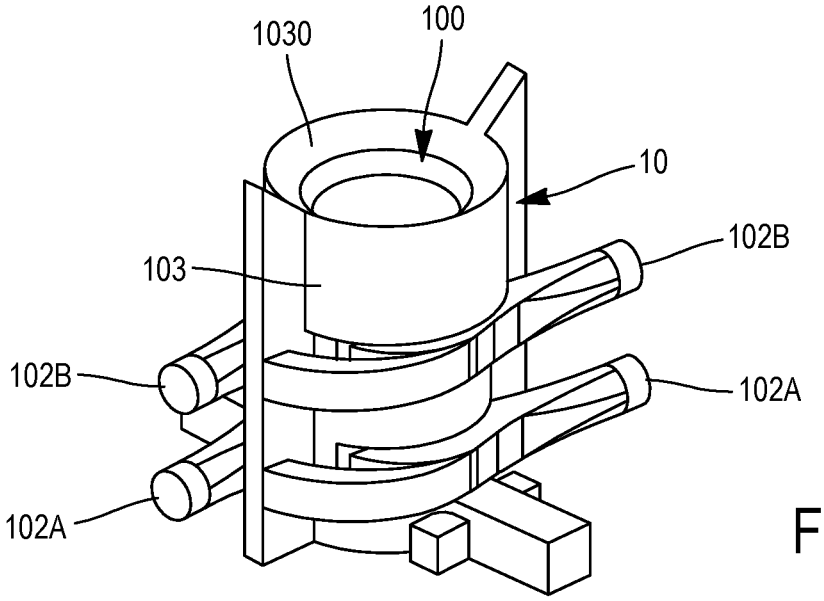

The structure of the element 10 will be better understood by observing FIGS. 5D and 5E, which represent the element 10 in its initial position at the end of its manufacturing and in its position of use respectively.

The element 10 is advantageously made by injecting a thermoplastic polymeric material, which gives the possibility of making in one piece the arms 102A, 102B extending radially from the body 103 and connected to the latter through a hinge 106 which is typically obtained by locally decreasing the thickness of the material.

Said hinge 106 gives the possibility of folding each arm 10A, 1028 towards the body 103, as illustrated in FIG. 5E.

Moreover, each arm 102A, 1028 comprises a protrusion 104, which advantageously assumes the shape of a rounded and bevelled portion, laid out facing an aperture 103A, 1038 of the body when the arms 102A, 1028 are folded back towards the body.

Depending on the strain exerted on the arms 102A, 102B, the protrusions 104 pair wise extend more or less into the inside of the conduit 100, and thereby form the upstream and downstream obturators which define the chamber intended to receive the bead(s) to be dispensed.

Advantageously, and as discussed above with reference to FIG. 2D, the sliding of the element 10 into the element 11 in the axial direction provides mixing of the beads contained in the tank and thus avoids bracing phenomena by the geometrical organization of the spherical or elongated objects with convex ends.

In the case of elongated objects, this mixing makes it possible to orient the objects so as to have them enter the conduit 100 in the direction of their length, as explained with reference to FIG. 4.

It will be noted that this dispenser, which is particularly simple since it exclusively consists of two parts (each of one piece), i.e. the elements 10 and 11, allows both efficient mixing of the objects and accurate counting of the objects to be dispensed.

Figure 6A:
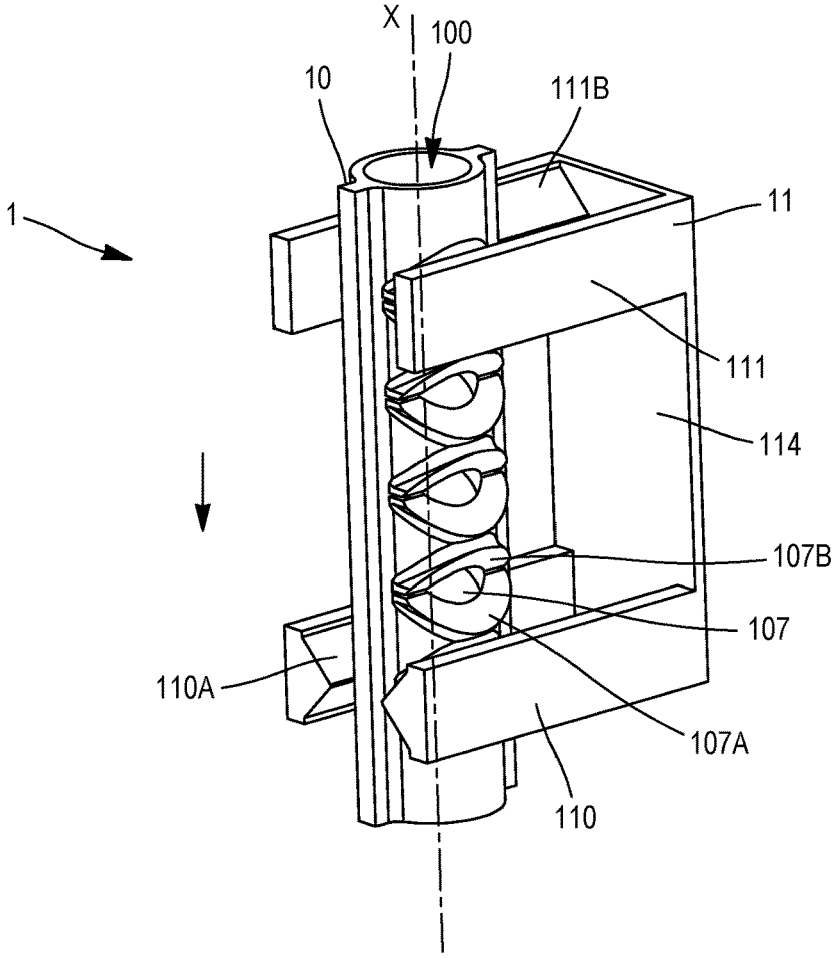
Figure 6B:
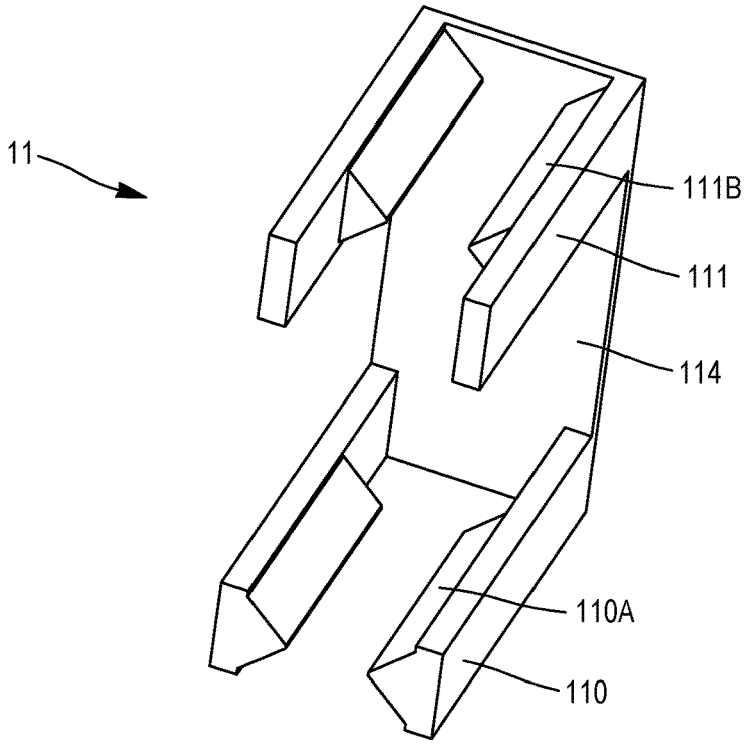
Figure 6C:
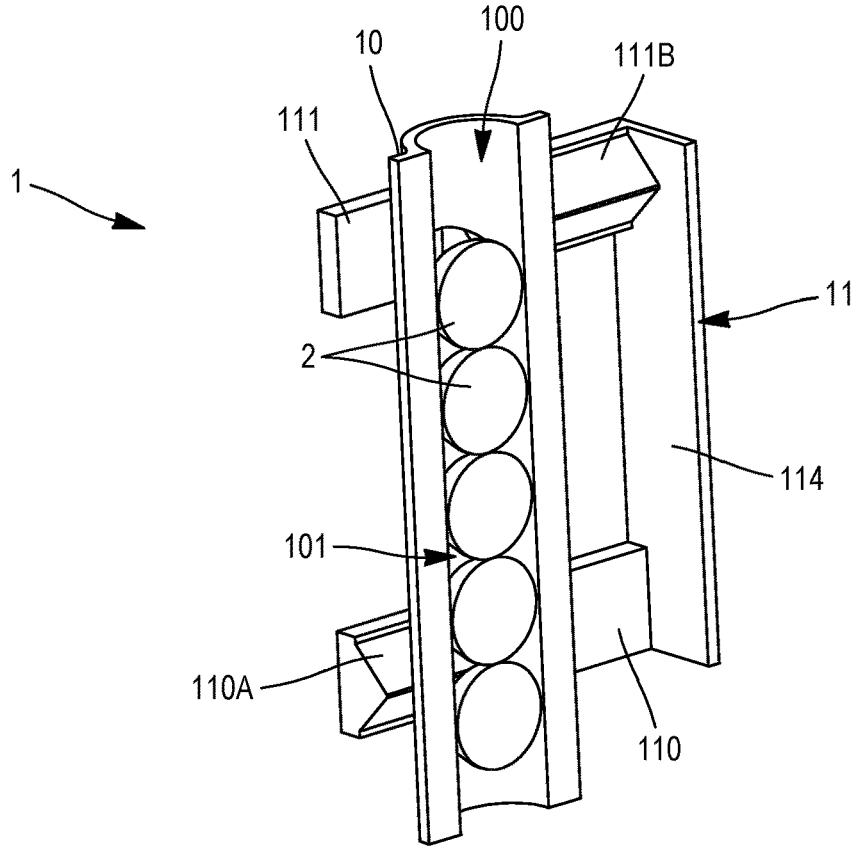

With reference to FIGS. 6A to 6C, a second embodiment of a dispenser according to the invention will now be described.

The dispenser 1 comprises an element 10 of a generally tubular shape extending along the axis X and the inner wall of which defines the conduit 100 for dispensing the beads. The wall of said element 10 comprises diametrically opposite apertures 107 and each surrounded by two protruding ribs 107A, 1078 from the outer wall of the element 10.

The dispenser moreover comprises an element 11 adapted for sliding on the element 10 in a direction perpendicular to the axis X while being guided between the ribs 107A, 107B.

For this purpose, the element 11 comprises two parallel arms 110, 111 which extend perpendicularly to the axis X, said arms 110, 111 being connected through a wall 114 extending in a plane perpendicular to said arms.

As this is better seen in FIG. 6B, each arm 110, 111 has a respective protrusion 110A, 111B (which is advantageously bevelled) facing the protrusion of the opposite arm. Moreover, the protrusion 110A of an arm 110 is not entirely located facing the protrusion 111B of the arm 111: a central portion of each of the arms 110, 111 is provided with a protrusion, said protrusion extending towards an end of the arms 111 and towards the opposite end of the arms 110.

Each protrusion allows sliding of the element 11 between the ribs 107A, 107B of the element 10. The end of said protrusion extends towards the inside of the conduit 100 when the protrusion is facing the aperture 107.

The protrusions 111B facing each other therefore form an upstream obturator and the protrusions 110A facing each other form a downstream obturator. The operating sequence of said obturators is similar to the one described in reference with FIGS. 2A-2D, the difference lying in that the relative sliding of the elements 10 and 11 is performed here in a plane perpendicular to the axis X. Unlike the embodiment of FIGS. 5A to 5E, the embodiment of FIGS. 6A to 6C therefore does not provide any controlled mixing of the objects contained in the tank.

In the example illustrated here, the chamber 101 defined between said obturators is designed for receiving four beads (cf. FIG. 6C), but it is obvious that it may be designed for receiving a different number of beads or spherical or elongated objects with convex ends, including a single object.

In this respect, it will be noted that the wall of the element 10 is illustrated with a plurality of apertures 107 and of corresponding ribs 107A, 107B. Only a pair of apertures upstream from the chamber 101 and a pair of apertures downstream from said chamber is sufficient for producing the dispenser. However, the presence of several apertures and ribs gives the possibility of adjusting the number of beads received in the chamber 101 simply by modifying the spacing of the arms 110, 111 of the element 11 along the axis X.

Like in the previous embodiment, each of the elements 10 and 11 may be made in one piece. The dispenser is therefore exclusively produced from two parts, the assembling of which is very simple.

According to an embodiment, the dispenser may comprise a relative return device for the elements 10 and 11, regardless of the contemplated embodiment.

This return device may for example comprise an elastic member laid out between the elements 10 and 11 so as to bring back both upstream and downstream obturators in an open configuration and in an obturation configuration respectively of the chamber.

Advantageously, said elastic return member may be produced in a single piece with one of the first and second elements described above and may thus be made without adding any part in either one of the architectures.

Figure 7A:
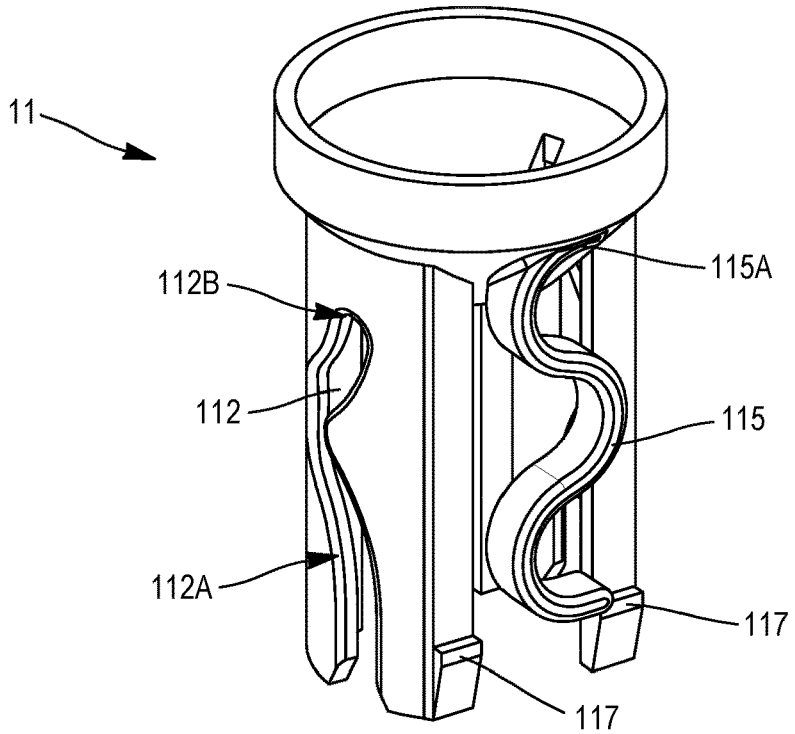
Figure 7B:
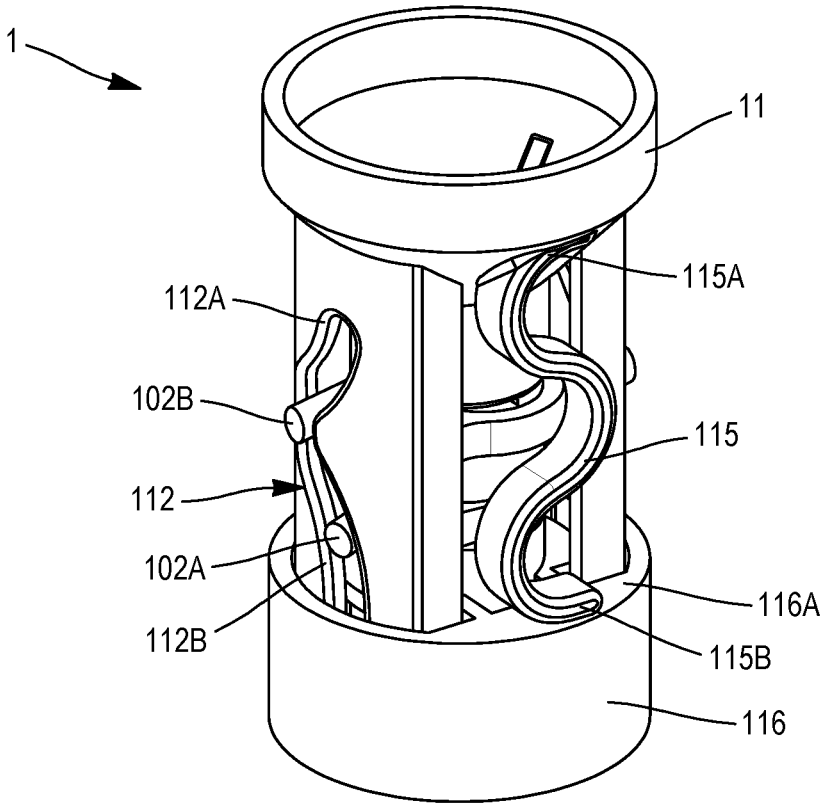

FIGS. 7A and 7B thereby illustrate a perspective view of the element 11 and a perspective view of the dispenser 1 assembled according to an alternative of the embodiment of FIGS. 5A-5E. The elements already described with reference to FIGS. 5A to 5E are not again described.

The element 11 comprises a curved leaf 115 (for example S-shaped) which extends in the axial direction, said leaf being connected to the wall of the element 11 at its end 115A, the opposite end 115B being free.

Advantageously, the leaf 115 is an integral part of the element 11 and may thus be made by molding the element 11.

The leaf 115 has some elasticity which depends on its shape, on its dimensions and on the material used.

The element 10 comprises at its downstream end, a flange 116 comprising a supporting surface intended to be facing the free end 115B of the elastic leaf when the element 10 is mounted by sliding in the element 11. In particular, the flange 116 comprises, on the upstream side, a supporting surface 116A on which the free end 115B of the leaf 115 may rest.

The element 11 comprises abutment members 117 forming an abutment towards the downstream side of the flange 116.

When the dispenser 1 is thus assembled, the leaf 115 tends to push back the element 10 in the axial direction towards the downstream side, in a position in which the upstream obturator is in an open configuration and the downstream obturator is in an obturation configuration, as illustrated in FIG. 7B (see also FIG. 2B).

When the intention is to dispense objects, the element 10 is slid in an axial direction towards the upstream side, against the force exerted by the leaf 115.

In a first phase, this sliding places both obturators in an obturation configuration of the chamber (cf. FIG. 2C).

In a second phase, as the sliding continues towards the upstream side, the upstream obturator remains in an obturation configuration while the downstream obturator passes into an open configuration of the chamber (cf. FIG. 2D). By doing this, the object(s) which was (were) contained in the chamber is (are) released from the dispenser.

The element 10 is then released, which is pushed back by the leaf 115 in the axial direction towards the downstream side and which thus brings it back into the configuration illustrated in FIG. 7B. As the upstream obturator is in an open configuration of the chamber, new objects may be introduced into the chamber while being retained by the downstream obturator which is in the closing configuration.

Figure 8A:
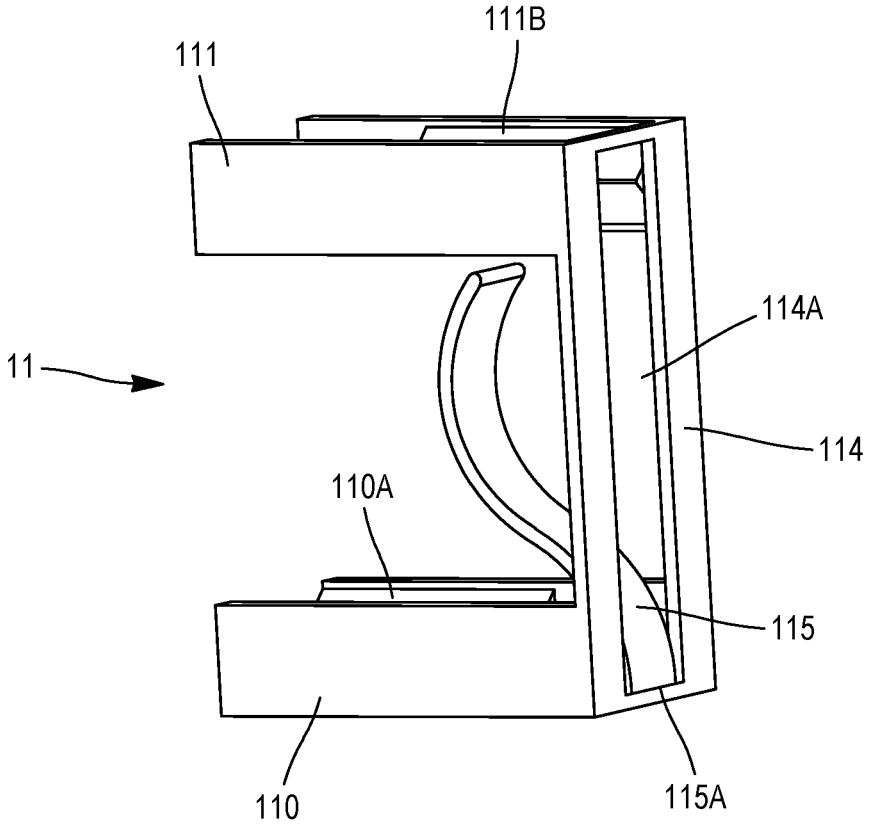
Figure 8B:
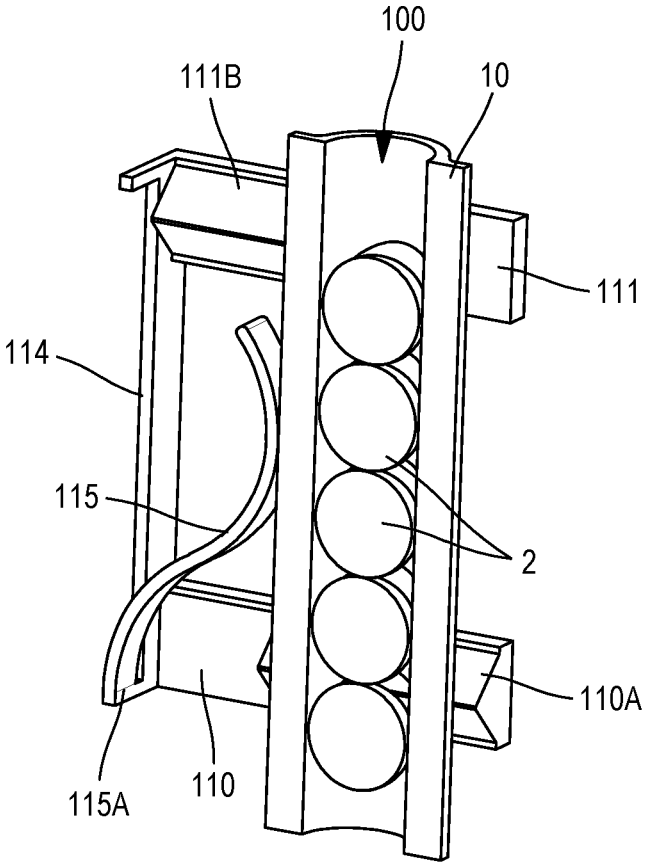

FIGS. 8A and 8B respectively illustrate a perspective view of the element 11 and a perspective view of the dispenser 1 assembled according to an alternative of the embodiment of FIGS. 6A-6C. The elements already described with reference to FIGS. 6A to 6C are not described again.

The wall 114 has a longitudinal notch 114A in which extends a curved leaf 115 protruding in the direction of the arms 110, 111, the leaf 115 being secured to the wall 114 at one of its ends 115A.

Advantageously, the leaf 115 is an integral part of the element 11 and may thus be made by molding the element 11.

The leaf 115 has some elasticity which depends on its shape, on its dimensions and on the material used.

When the element 10 is slidably mounted on the element 11, the leaf 115 tends to push back the element 10 in the direction opposite to that of the wall 114, in a position in which the upstream obturator is in an open configuration and the downstream obturator is in an obturation configuration, as illustrated in FIG. 8B.

When the intention is to dispense objects, the element 10 is slid towards the wall 114, against the force exerted by the leaf 115.

In a first phase, this sliding places both obturators in an obturation configuration of the chamber by cooperation of the element 11 simultaneously with the protrusions 110A and 111B of both arms.

In a second phase, as the sliding continues towards the wall 114, the upstream obturator remains in an obturation configuration by cooperation of the element 10 with the protrusion 111B, while the downstream obturator passes into an open configuration of the chamber, the element 10 disengaging from the protrusion 110A. By doing this, the object(s) which was (were) contained in the chamber is (are) released from the dispenser.

The element 10 is then released, which is pushed back by the leaf 115 in the direction opposite to the wall 114 and which thus brings it back into the configuration illustrated in FIG. 8B. As the upstream obturator is in an open configuration of the chamber, new objects may be introduced into the chamber while being retained by the downstream obturator which is in a closing configuration.

The dispenser, various embodiments of which have been described above, may appear as a component to be assembled on a tank containing objects to be dispensed. The dispenser then has dimensions allowing it to be adapted on an existing tank, such as a tube, notably a tube for homeopathic granules. Securing the dispenser on the container is achieved by any suitable means, including a weld, an adhesive bonding, snap-on fastening, etc.

Alternatively, the dispenser may comprise the tank, for example by ensuring that one of the elements is manufactured in one piece with the tank. In the case when the dispenser has an axial sliding architecture (embodiment of FIGS. 5A to 5E), it is the element 11 which is integrated to the tank, the element 10 comprising the dispensing conduit 100 being movable by axial sliding and thereby allowing mixing of the objects contained in the tank. In the case when the dispenser has a sliding architecture in a plane perpendicular to the longitudinal axis, the element 10 comprising the dispensing conduit 100 is advantageously integrated to the tank, the element 11 being movable.

REFERENCES

EP 0 002 403
FR 2 759 677
FR 2 867 459
CA 1,297,844
FR 2 928 356

The invention claimed is:

1. A device for counting and dispensing objects, comprising a first element comprising a conduit for dispensing objects to be counted and dispensed, the conduit comprising an axis defining a direction of flow of the objects within the conduit, a second element cooperating with the first element such that the first and second elements together operate first and second obturators arranged in upstream and downstream portions of the conduit, the first obturator spaced from the second obturator such that the first and second obturators operate independently, the obturators delimiting in the conduit a chamber adapted for containing a pre-determined number of said objects, wherein the first and second elements are slidably movable relative to each other along the axis of the conduit, each of the first and second obturators being able to implement, depending on the relative position of said first and second elements:

an open configuration of the chamber, in which opposite ends of each of the first and second obturators define an orifice with a dimension adapted for letting through an object to be counted and dispensed, and an obturation configuration of the chamber, in which opposite ends of each of the first and second obturators are closer than a respective open configuration so that said orifice has a dimension insufficient for letting through an object, one of the opposite ends of said first and second obturators having a beveled portion facing a beveled portion of the other one of the opposite ends of the first and second obturators and not contiguously joined in said obturation configuration, the first and second elements being slidably arranged relative to each other so as to provide, by relative sliding along the axis of the conduit, a sequence for operating the obturators wherein:

(i) a first obturator is in said open configuration while the second obturator is in said obturation configuration of the chamber, (ii) the first and the second obturators are both in said obturation configuration of the chamber, (iii) the first obturator is in said obturation configuration while the second obturator is in said open configuration of the chamber, (iv) the first and the second obturators are both in said obturation configuration of the chamber; and wherein the first element is slidably arranged relative to the second element along an axial direction of the conduit so that, during a portion of the operating sequence, the first element moves towards an upstream side into a storage area relatively to the direction of flow of the objects, so as to provide mixing of the objects to be counted and dispensed located upstream from the conduit.

2. The device according to claim 1, wherein the conduit has, at its upstream end, a tilted wall so as to orient and/or guide in the conduit the objects to be counted and dispensed.

3. The device according to claim 1, further comprising a relative return device for the first and second elements.

4. The device according to claim 3, wherein said return device comprises an elastic return member secured to the first or to the second element.

5. The device according to claim 1, wherein the first and the second element are each separately made in one piece, the device consisting of said first and second elements.

6. The device according to claim 1, further comprising a container containing objects.

7. The device according to claim 6, wherein the objects are one of homeopathic granules, gel capsules, tablets, capsules or microgranules.

8. The device for counting and dispensing objects of claim 1, wherein the first element includes a sloped wall configured to provide mixing of the objects located upstream from the conduit by contacting the object with the sloped wall of the first element.

9. The device for counting and dispensing objects of claim 1, wherein the first and second obturators move independently from each other.

10. The device for counting and dispensing objects of claim 1, wherein the storage area is a tank.

11. A device for counting and dispensing objects, comprising two slidably movable elements relatively to each other, a first element comprising a conduit for dispensing objects to be counted and dispensed, a second element cooperating with the first element for operating first and second obturators delimiting in the dispensing conduit a chamber adapted for containing a pre-determined number of said objects, the first obturator spaced from the second obturator such that the first and second obturators operate independently, each of the first and second obturators being configured to adopt, depending on a relative position of said first and second elements:

an open configuration of the chamber, in which each of the first and second obturators defines an orifice with a dimension adapted for letting through an object to be counted and dispensed, and an obturation configuration of the chamber, in which said orifice has a dimension insufficient for letting through an object, each of the first and second obturators having two beveled portions facing each other and not contiguously joined in said obturation configuration, the first and second elements being slidably arranged relative to each other so as to provide, by relative sliding, an operating sequence for operating the obturators wherein:

(i) the first obturator is in an open configuration while the second obturator is in an obturation configuration of the chamber, (ii) the first and the second obturators are both in an obturation configuration of the chamber, (iii) the first obturator is in an obturation configuration while the second obturator is in an open configuration of the chamber, (iv) the first and the second obturators are both in an obturation configuration of the chamber, wherein the first element is slidably laid out with respect to the second element along an axial direction of the conduit so that, during a portion of the operating sequence, the first element moves towards the upstream side into a storage area relatively to the direction of flow of the objects, so as to provide mixing of the objects to be counted and dispensed located upstream from the conduit.

12. The device for counting and dispensing objects of claim 11, wherein the first and second obturators move independently from each other.

13. The device for counting and dispensing objects of claim 11, wherein the storage area is a tank.

* * * * *